343-909 3R
8/21/84 XR 4,467,330

United States Patent [19]

Vidal et al.

[11] Patent Number: 4,467,330

[45] Date of Patent: Aug. 21, 1984

[54] DIELECTRIC STRUCTURES FOR RADOMES

[75] Inventors: Paul F. Vidal, Stow, Mass.; Fred N. S. Goodrich, Barnstead, N.H.

[73] Assignee: Radant Systems, Inc., Stow, Mass.

[21] Appl. No.: 334,970

[22] Filed: Dec. 28, 1981

[51] Int. Cl.[3] ..... H01Q 1/42

[52] U.S. Cl. ..... 343/872; 343/909

[58] Field of Search ..... 343/872, 909, 911 R, 343/753, 754, 755, 911 L

[56] References Cited

U.S. PATENT DOCUMENTS 2,841,786 7/1958 Dicke ..... 343/909

3,633,206 1/1972 McMillan ..... 343/909

*Primary Examiner*—Eli Lieberman

*Attorney, Agent, or Firm*—Robert F. O'Connell

[57] ABSTRACT

A structure, useful, for example, as a radome, which in a preferred embodiment comprises a dielectric material which has placed within it a plurality of ring-shaped elements, each forming a completely closed loop configuration, such elements producing an inductive effect substantially equal to the capacitive effect of the dielectric material so as to match the electrical characteristics of the structure to a selected range of frequencies of electromagnetic energy which is to be transmitted therethrough.

15 Claims, 6 Drawing Figures

FIG.1
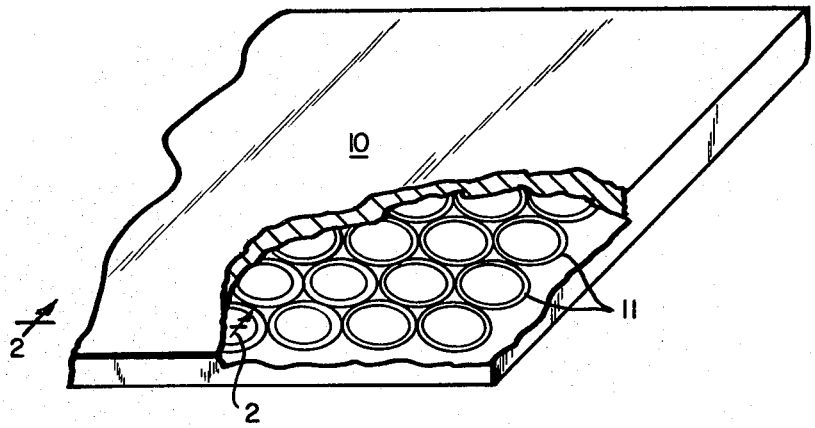
FIG. 2
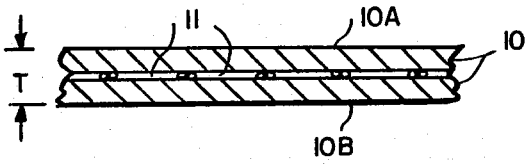
FIG.3
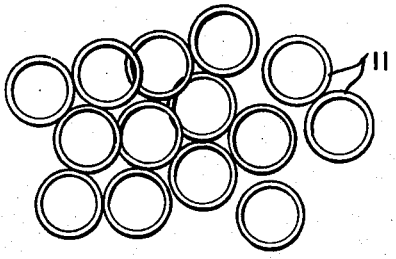
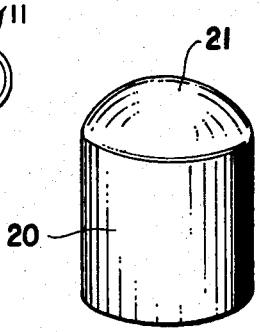
FIG.7
FIG. 4
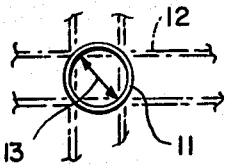
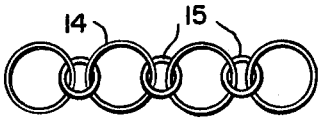
FIG.5
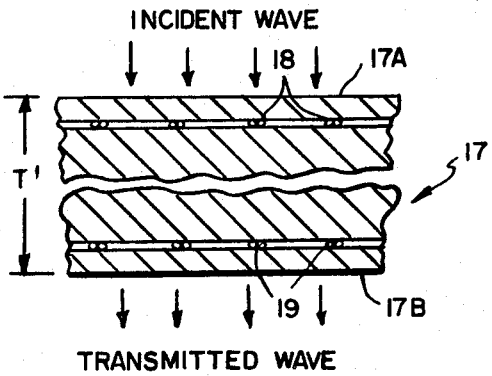
FIG. 6

DIELECTRIC STRUCTURES FOR RADOMES

INTRODUCTION

This invention relates generally to structures using dielectric materials and, more particularly, to radome structures having novel configurations designed to prevent the degradation of the electrical performance characteristics of an electromagnetic energy source which is enclosed therein.

BACKGROUND OF THE INVENTION

The primary purpose of radome structures is to protect antennas, which are mounted within, from direct exposure to the environment. If a random skin is constructed of a single layer of material, for example, it would produce a minimum reflection of the high-frequency energy generated by the antenna when the electrical thickness of the layer is equal to one half the wave length in the radome material of the high-frequency energy being propagated there through. A maximum reflection of such energy and, hence, a maximum degradation of the electrical performance characteristics of the antenna, would occur when the electrical thickness is equal to one quarter of such wave length. Accordingly, attempts to reduce the weight of the overall radome construction, and hence its cost, by reducing the material thickness thereof tend to result in greater reflection of the high-frequency energy which in turn undesirably decreases the transmission of such energy through the radome. In addition, the material becomes less mechanically strong.

DISCUSSION OF THE PRIOR ART

Various matching techniques have been suggested by those in the art in order to reduce the undesirable effect of increased reflections which occur when the thickness is reduced. In the case of high-frequency energy in which the source is linearly polarized, for example, a network of parallel metallic wires are appropriately arranged within the dielectric material which makes up the radome skin in such a way that the inductive effect of the wire network over a selected range of frequencies becomes approximately equal to the capacitive effect which is created by the dielectric. The result is that the relatively thin radome skin is then matched, or tuned, to a particular range of frequencies and transmission therethrough is enhanced.

In the case of circular polarized high frequency energy, for example, two orthogonal wire networks are usually arranged within the dielectric material so as to obtain the desired matching. However, such a technique is generally not effective when used with non-developable surfaces because the criteria for orthogonality cannot be met exactly. For example, for a spherical surface it is not possible to have truly orthogonally crossed wires over the entire surface of the sphere.

Other matching techniques which have been used or suggested by those in the art, especially for non-developable surfaces, include the placing within the dielectric material of either inductive metal springs, or coils, or the placing of inductive discs which produce various matching effects depending on their diameters. Such techniques, however, give rise to difficult and expensive fabrication problems since the relative positioning of the elements and their three dimensional orientations, particularly in the case where coils are used, must be calculated exactly and the positioning must be extremely carefully implemented in the manufacturing process. The implementation of such techniques is especially difficult for non-developable surfaces and the ideal positioning of such elements becomes substantially impossible.

BRIEF SUMMARY OF THE INVENTION

It is desirable, therefore, to develop a relatively simple matching technique for use in a dielectric material of any thickness, or of any contour, which technique results in a structure which is relatively easy and inexpensive to fabricate. The system in accordance with a preferred embodiment of the invention comprises the placement, within the dielectric material, of a plurality of metallic annular, or generally ring shaped, elements which are arranged generally in a side-by-side relation and are positioned so as to be substantially transverse to the incident wave of the high-frequency energy which passes through the dielectric material. More specifically, in a relatively thin sheet, or panel, of material (i.e., one having a thickness of less than one-half the wavelength of the high-frequency energy) the ring shaped elements are arranged in a plane parallel to, and half way between, the surfaces of the sheet. The capacitive effect of the dielectric is then balanced by the inductive effect of the rings. In accordance therewith, each of the rings must make a complete 360° loop. However, such rings need not make either electrical or mechanical contact with its neighboring rings. Moreover, the positioning of the rings relative to each other does not require any exact calculations and any appropriate spacing between the rings can be used. Thus, the rings can be arranged generally either contiguously in contact with each other, or spaced from, and out of contact with, each other or in any random combination of such relationships. The ability to place the rings in a non-exact configuration is especially useful when fabricating radomes having non-developable surfaces, such as small spheres.

DESCRIPTION OF THE INVENTION

The invention can be described in more detail in accordance with the drawing wherein FIG. 1 depicts a portion of a structure which represents a specific embodiment of the invention;

FIG. 2 shows a view in section along the line 2—2 of FIG. 1;

FIG. 3 shows a portion of a structure which depicts another arrangement of the elements therein;

FIG. 4 shows a diagram helpful in determining the inner diameter of an element of the invention;

FIG. 5 shows an alternative embodiment of the elements of the invention; and FIG. 6 shows a further alternative embodiment of the invention.

FIG. 7 shows a structure in which the invention can be used.

As can be seen in FIGS. 1 and 2, the radome material comprises a dielectric material 10 having a selected thickness T between surfaces 10A and 10B thereof. Such material may be, for example, a fiberglass resin material of any suitable type well known to those in the art having a selected dielectric constant. In the configuration shown the dielectric material is in the form of a relatively thin sheet, or panel, having a thickness less than one-half the wave length in the radome material of the high frequency energy which is to be transmitted therethrough. Embedded in the central region thereof in a plane substantially parallel to and half-way between the surfaces 10A and 10B (i.e., generally transverse to the incident wave of the energy impinging the panel) are a plurality of metallic wire ring-like members 11, each having a selected inner diameter and a selected wire diameter. The metallic rings are placed generally in a side-by-side arrangement throughout the entire configuration. As shown in the portion of the structure pictured in FIG. 1, the rings can be placed in a "substantially regular" arrangement as depicted. The term "substantially regular" as used herein shall mean a generally symmetric arrangement of elements through the material in which each ring element is generally tangential to and in electrical/mechanical contact with its neighboring rings.

However, as mentioned above, while such substantially regular configuration can be purposely constructed as shown, the tangential contact, either electrical and/or mechanical between each of the rings, is not completely necessary and the rings may be spaced at some reasonable distance from each other or may overlap each other, as depicted in FIG. 3, for example. As seen therein, some of the rings are completely out of contact with any of their neighbors or are in contact with one or more neighboring rings but out of contact with one or more others. Moreover, some rings are overlapped with one or more adjacent rings. An arrangement of such a nature which is not "substantially regular", as defined above, can be referred to by the term "quasi-regular" as used herein. Hence, no calculations for the positioning of the rings are required.

In a specific embodiment wherein the rings are placed in a quasi-regular arrangement, spacing between the rings may be in the order of magnitude of the wire diameter thereof. For example, for rings having wire diameters of about 0.5 mm. the spacings may be as high as 0.5 mm. to 2.0 mm., without deleterious effects on the performance characteristics of the material.

A specific embodiment of a radome structure made in accordance with the invention was designed to provide transmission through the radome of high-frequency energy lying within a range from 7000 MGz to 8500 MHz, with transmission losses equal to or less than about 0.3 dB. In such configuration the fiberglass resin material had a dielectric constant of 3.5 and a thickness of about 7 mm. and each of the metallic rings embedded within the dielectric material had an inside diameter of about 12 mm. and wire diameters of about 0.5 mm. In contrast the transmission loss of an uncompensated panel of the same material having substantially the same thickness has been found to be about 2.1 dB for high frequency energy of 7500 MHz.

As depicted in FIG. 4, a useful criterion for determining the inner diameter of the ring configuration in a particular embodiment of the invention is to consider an equivalent orthogonally crossed wire network of the prior art and to use as the diameter of the ring a length about equal to the inside diagonal 13 of the square openings formed by the crossed wire network 12 (shown in phantom in the figure). In fabricating structures in accordance with the invention, a nominal determination of the inner diameter of the closed loop can be made in this manner and the wire diameter can be initially selected, such diameters then being further adjusted empirically by suitable experimentation in accordance with the thickness and the dielectric constant of the dielectric material which is being used before a final determination of their values is made.

While the specific embodiments discussed above provide effective structures for the purposes described, modifications thereof may be useful in some applications. FIG. 5, for example, depicts a structure in which a first group of rings 14 having a first inner diameter are linked to each other in a chain-like configuration by a second group of rings 15, each having a much smaller inner diameter. Such linked elements are then appropriately positioned within the dielectric material.

In some applications the thickness of the dielectric material may be greather than one-half the wavelength ($\lambda/2$) in the radome material of the high-frequency energy which passes therethrough. For example, in some environments it might be necessary to provide added mechanical strength to the material. In such cases the ring-like elements can be arranged as shown in FIG. 6. As seen therein, a panel 17 of dielectric material has first and second surfaces 17A and 17B and a thickness T' which is greater than $\lambda/2$. A first layer of ring-shaped elements 18 is arranged within the panel in a first plane parallel to and adjacent surface 17A at which the incident wave of high-frequency energy initially impinges. A second layer of ring-shaped elements 19 is arranged within the panel in a second plane parallel to and adjacent surface 17B at which the wave leaves the panel. In each case the plane of the rings is positioned at a little greater than one-eighth wavelength ($\lambda/8$) in the radome material from its corresponding adjacent surface.

Moreover, other element shapes may also be used in accordance with the invention. Thus, the elements may be formed as individual rectangles, or squares, for example, such shapes being useful for linearly polarized signals, so long as the elements involved form 360° closed loop configurations. Combinations of element shapes may also be used. For example, a cylindrically shaped radome, one end of which is hemispherically, or domed, shaped, may use square elements on the cylindrical (the developable) surface 20 and circular, or ring-like, elements on the hemispherical (the non-developable) surface 20, as shown in FIG. 7.

Moreover, while the invention discussed above is found to be useful in a radome structure, the configurations thereof may also find a use for other purposes such as, for example, in electromagnetic (optic) lens systems or as electromagnetic energy filters where it is desired to enhance transmission substantially only over a selected frequency range. Other modifications may occur to those in the art within the spirit and scope of the invention. Hence, the invention is not to be limited to the particular embodiments disclosed herein, except as defined by the appended claims.

What is claimed is:

1. A structure for permitting transmission of electromagnetic energy therethrough comprising a dielectric material capable of being formed into a structure having a selected configuration; and a plurality of metallic elements, each forming a completely closed loop configuration, placed within said dielectric material and arranged in a configuration such that a plurality of said elements are in contact with one or more elements adjacent thereto, said elements producing an inductive effect substantially equal to a capacitive effect produced by said dielectric material so as to match the electrical characteristics of said structure to a selected range of frequencies of said electromagnetic energy.

2. A structure in accordance with claim 1 wherein said metallic elements are formed as ring-like elements.

3. A structure in accordance with claim 2 wherein said ring-like elements have a circular configuration.

4. A structure in accordance with claims 1, 2 or 3 wherein said elements are arranged in at least one plane which is parallel to at least one surface of said dielectric material.

5. A structure in accordance with claim 4 wherein said dielectric material has a thickness less than one-half the wavelengths of any of the electromagnetic energy within said selected range of frequencies; and said elements are arranged in a plane which is substantially parallel to and half-way between the surfaces of said dielectric material.

6. A structure in accordance with claim 3 wherein said circular shaped elements are formed of wire material having a selected cross-sectional diameter and a circular shape having a selected inner diameter, the values of said cross-sectional diameter and said inner diameter being selected in accordance with the selected range of frequencies, the thickness of said dielectric material and the dielectric constant of said dielectric material.

7. A structure in accordance with claim 6 wherein said range of frequencies is from 7000 MHz to 8500 MHz, said wire elements having a cross-sectional diameter of about 0.5 mm. and said circular shape having an inner diameter of 12 mm.

8. A structure in accordance with claim 7 wherein said dielectric material is a fiberglass resin material having a dielectric constant of about 3.5 and a thickness of about 7 mm.

9. A structure in accordance with claim 1 wherein said metallic elements comprise a first plurality of ring-like elements having a first inner diameter and a second plurality of ring-like elements having a second inner diameter, said first and second plurality of rings being connected in a chain-like fashion.

10. A structure in accordance with claim 1 wherein said metallic elements are arranged in a quasi-regular configuration within said dielectric material such that a further plurality of elements are not in contact with any elements adjacent thereto, the distance between said further plurality of elements and those adjacent thereto being about the same order of magnitude as, or less than, the cross-sectional dimension of said elements.

11. A structure in accordance with claim 1 wherein said elements are arranged in a substantially regular arrangement, said elements generally being in tangential mechanical and electrical contact with each of its adjacent elements.

12. A structure in accordance with claim 1 wherein said dielectric material is formed into a structure having a first developable surface and a second non-developable surface, a first plurality of said metallic elements having a first closed loop configuration being placed within the portion of said dielectric material which forms said developable surface and a second plurality of said metallic elements having a second closed loop configuration being placed within the portion of said dielectric material which forms said non-developable surface.

13. A structure in accordance with claim 4 wherein said dielectric material has a thickness greater than one-half the wavelengths in the structure of any of the electromagnetic energy within said selected range of frequencies;

a first plurality of said elements are arranged in a first plane which is substantially parallel to and adjacent a first surface of said dielectric material; and a second plurality of said elements are arranged in a second plane which is substantially parallel to and adjacent a second surface of said dielectric material.

14. A structure in accordance with claim 13 wherein first and second said planes are spaced from said first and second surfaces, respectively, by a little greater than one-eighth wavelength of any of the electromagnetic energy within said selected range of frequencies.

15. A structure in accordance with claims 1 through 14 wherein said structure is formed for use as a radome structure.

* * * * *